US007240769B2

(12) United States Patent
Nezan et al.

(10) Patent No.: US 7,240,769 B2
(45) Date of Patent: Jul. 10, 2007

(54) EXHAUST VOLUME

(75) Inventors: Stéphane Nezan, Seloncourt (FR); Christian Sarda, Dasle (FR)

(73) Assignee: Faurecia Systemes d'Echappement, Boulogne (FR)

( * ) Notice: Subject to any disclaimer, the term of this patent is extended or adjusted under 35 U.S.C. 154(b) by 0 days.

(21) Appl. No.: 11/153,333

(22) Filed: Jun. 16, 2005

(65) Prior Publication Data

US 2005/0230182 A1 Oct. 20, 2005

Related U.S. Application Data

(63) Continuation of application No. 10/048,593, filed on Feb. 1, 2002, now abandoned.

(51) Int. Cl.
*F01N 1/02* (2006.01)
*F01N 7/16* (2006.01)
*F01N 1/08* (2006.01)

(52) U.S. Cl. ..... 181/250; 181/273; 181/276

(58) Field of Classification Search ..... 181/250, 181/273, 276, 282, 283
See application file for complete search history.

(56) References Cited

U.S. PATENT DOCUMENTS 2,103,810 A * 12/1937 Caspar ..... 181/273
2,297,046 A * 9/1942 Bourne ..... 181/250
3,087,579 A 4/1963 Katogir
3,114,432 A 12/1963 Ludlow et al.
3,396,812 A * 8/1968 Wilcox et al. ..... 181/250
3,402,785 A * 9/1968 Heath et al. ..... 181/250
3,415,338 A * 12/1968 McMillan ..... 181/227
3,655,011 A * 4/1972 Willett ..... 181/228
4,038,820 A * 8/1977 Tsukamoto ..... 60/314
4,449,608 A * 5/1984 Hirata et al. ..... 181/228
4,540,064 A * 9/1985 Fujimura ..... 181/227
4,645,031 A * 2/1987 Omura et al. ..... 181/232
4,727,957 A 3/1988 Fujita
4,842,096 A * 6/1989 Fujitsubo ..... 181/252
4,924,966 A * 5/1990 Kanda et al. ..... 181/228
5,321,214 A 6/1994 Uegane et al.
5,323,989 A * 6/1994 Hamada et al. ..... 248/60
5,424,494 A 6/1995 Houle et al.
5,493,080 A 2/1996 Moss
5,647,314 A * 7/1997 Matsumura et al. ... 123/184.57

(Continued)

FOREIGN PATENT DOCUMENTS

EP 77148 A1 * 4/1983

(Continued)

OTHER PUBLICATIONS

Patent Abstracts of Japan, vol. 017, No. 021, Jan. 14, 1993 & JP 04 246221 (Toyoda Gosei Co., Ltd.) Sep. 2, 1999.

*Primary Examiner*—Edgardo San Martin
(74) *Attorney, Agent, or Firm*—Sughrue Mion, PLLC

(57) ABSTRACT

An exhaust volume (20) of the type including a muffler (24) having a casing provided with an inlet (29) and an outlet (30) for passing gases and adapted to enable the muffler to be mounted in an exhaust system (14). The volume further includes an additional enclosure (26) forming an accumulation cavity communicating solely with the casing of the muffler (24) via at least one connection pipe (28), the additional enclosure (26) being placed outside the muffler (24). The additional enclosure (26) is of a structure whose ability to withstand high temperature is lower than that of the structure of the muffler (24).

13 Claims, 3 Drawing Sheets

U.S. PATENT DOCUMENTS

| | | | | |
|---|---|---|---|---|
| 5,661,973 | A * | 9/1997 | Casey | 60/279 |
| 5,723,828 | A | 3/1998 | Nakagawa | |
| 5,783,780 | A | 7/1998 | Watanabe | |
| 5,907,135 | A | 5/1999 | Hayakawa et al. | |
| 6,019,648 | A | 2/2000 | Lecours et al. | |
| 6,155,225 | A | 12/2000 | Suzuki | |
| 6,415,889 | B1 | 7/2002 | Wyatt | |
| 6,450,141 | B1 | 9/2002 | Sakuma | |
| 6,530,984 | B2 * | 3/2003 | Stuart | 96/380 |
| 6,531,091 | B2 | 3/2003 | Miyamoto et al. | |

FOREIGN PATENT DOCUMENTS

| | | |
|---|---|---|
| JP | 01211610 | 8/1989 |
| JP | 03237209 | 10/1991 |
| JP | 04262014 | 9/1992 |
| JP | 06264838 | 9/1994 |
| JP | 08284637 | 10/1996 |
| JP | 2000008830 | 1/2000 |

* cited by examiner

EXHAUST VOLUME

This is a continuation of application Ser. No. 10/048,593, filed Feb. 1, 2002 now abandoned. The entire disclosure of the prior application, application Ser. No. 10/048,593 is hereby incorporated by reference.

BACKGROUND OF THE INVENTION

The present invention relates to an exhaust volume of the type comprising a muffler having a casing provided with an inlet and an outlet for passing gases and adapted to enable the muffler to be mounted in an exhaust system.

The invention also relates to an exhaust system including such an exhaust volume. Finally, the invention relates to a motor vehicle including such an exhaust system.

On mass-produced vehicles, the exhaust volumes for damping sound waves are made by rolling up a sheet of metal and by crimping it together. End walls are then added to the ends of the resulting cylinder. Such exhaust volumes are said to be rolled and crimped.

The cost of manufacturing such exhaust volumes is moderate. Nevertheless, they are unsuitable for making optimum use of the empty space available beneath the body of a vehicle.

Thus, for high-power vehicles that require exhaust volumes of maximum capacity, such exhaust volumes are made by assembling together two stamped half-shells. Stamping half-shells makes it possible to give the shells a shape that is complementary to the bottom surface of the vehicle body. This optimizes use of the space available for the exhaust volume.

Nevertheless, stamped exhaust volumes are relatively expensive to manufacture since they require two half-shells to be shaped and then to be assembled together around their periphery. In addition, a special stamping tool must be manufactured for each type of exhaust volume and for each type of vehicle.

The invention seeks to provide an exhaust volume which enables the space available beneath a vehicle to be used rationally, which is light in weight, and which is of low manufacturing cost.

SUMMARY OF THE INVENTION

To this end, the invention provides an exhaust volume of the above-specified type, characterized in that it further comprises an additional enclosure forming an accumulation cavity communicating solely with the casing of the muffler via at least one connection pipe, said additional enclosure being placed outside the muffler, and in that the additional enclosure is of a structure whose ability to withstand high temperature is lower than that of the structure of the muffler.

In particular embodiments, the exhaust volume includes one or more of the following characteristics:

- the casing of the muffler is made of metal and the casing of the additional enclosure is made of a material comprising a polymer;
- the casing of the muffler is of steel and the casing of the additional enclosure is made of light alloy;
- the connection pipe is rigid and substantially undeformable by the weight of the additional enclosure at one end of said connection pipe; and
- the connection pipe includes an elastically-deformable segment, and the additional enclosure has rigid link means connecting it to the body of the vehicle.

The invention also provides an exhaust system of the type including an exhaust volume as defined above, an upstream exhaust tube connected to the inlet of the muffler, and a downstream exhaust tube connected to the outlet from the muffler.

In particular embodiments, the exhaust system includes one or more of the following characteristics:

- it includes rigid link means between the additional enclosure and the body of a vehicle, and flexible link means between the body of a vehicle and the upstream exhaust tube and at least one of the mufflers and the downstream exhaust tube; and
- it includes flexible link means between the body of a vehicle and both the upstream exhaust tube and at least one of the muffler and the downstream exhaust tube, and the additional enclosure has no link means connecting it to the body of the vehicle.

Finally, the invention provides a motor vehicle including at least one exhaust system as defined above, characterized in that the additional enclosure is received, at least in part, within a cavity situated beneath the structure of the vehicle or at one end of the structure of the vehicle.

BRIEF DESCRIPTION OF THE DRAWINGS

The invention will be better understood on reading the following description given purely by way of example and made with reference to the drawings, in which.

DETAILED DESCRIPTION OF THE INVENTION

Figure 1:
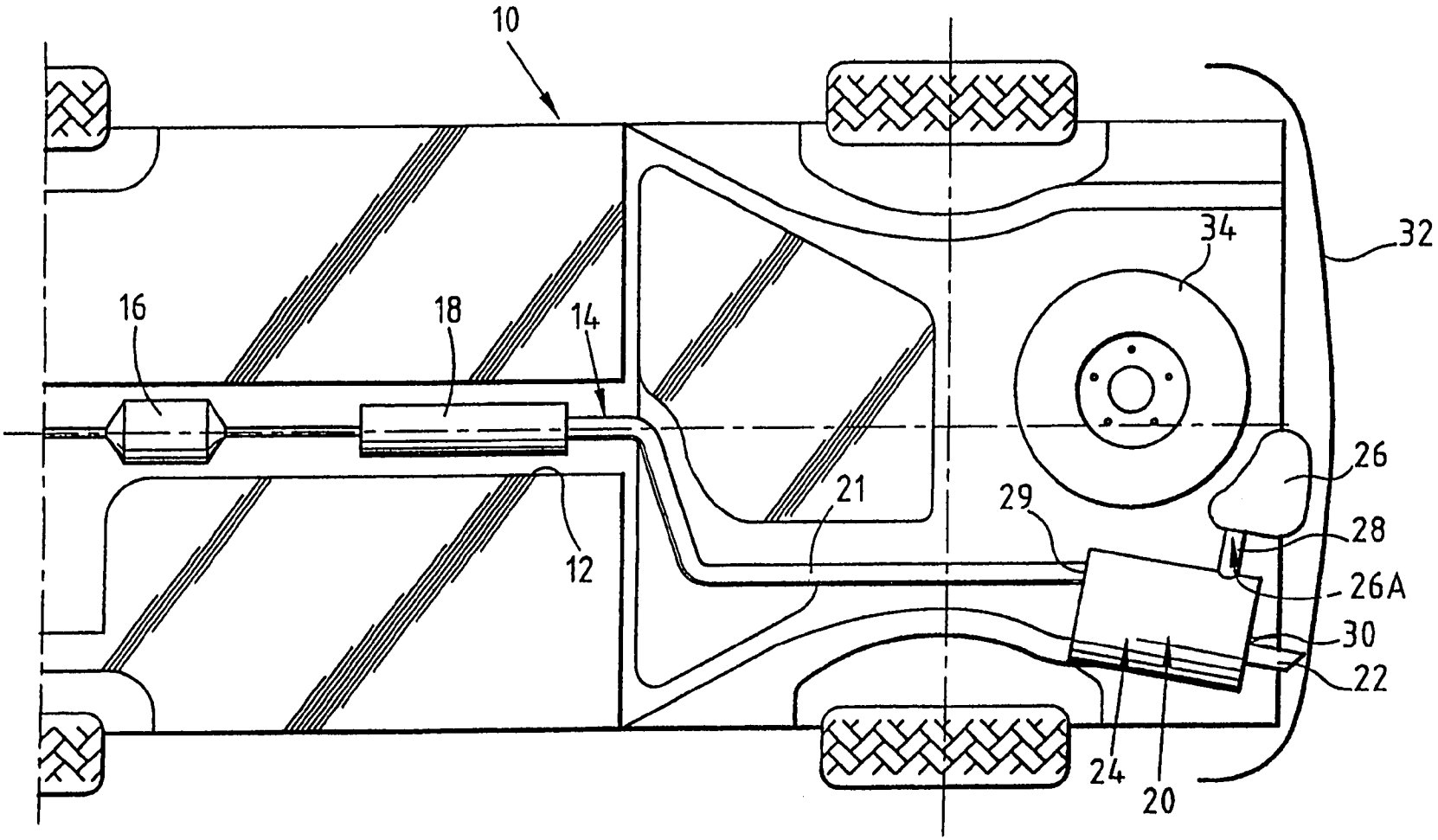
FIG. 1 is a fragmentary view of the underside of a motor vehicle including an exhaust volume of the invention.

FIG. 1 shows the bottom surface of a motor vehicle body 10, with the end fixed to the engine being omitted. The bottom face of the vehicle presents a channel 12 along which the exhaust system 14 of the invention extends. Starting from the engine, this exhaust system essentially comprises a catalytic purifier member 16, an intermediate muffler 18, and finally an exhaust volume 20 of the invention installed in the vicinity of the rear end of the vehicle. This exhaust volume is for reducing sound emission.

The exhaust members 16, 18, and 20 are connected in series in the exhaust system via connecting tubes 21. The exhaust volume 20 is extended at its outlet to an exhaust nozzle 22 allowing exhaust gases to be released into the atmosphere.

In accordance with the invention, the exhaust volume 20 comprises an exhaust muffler 24 associated with a resonator 26 forming an additional enclosure located outside the muffler 24. The resonator 26 forms a closed volume fitted with an access 26A. The muffler 24 and the resonator 26 communicate with each other via a connection pipe 28.

The resonator 26 communicates only with the muffler 24 and thus forms a cavity for accumulating gas in the exhaust system.

The connection pipe 28 connecting the resonator 26 to the muffler 24 is connected to the access 26A of the resonator. Its other end branches directly from the casing of the muffler.

In a variant, the pipe 28 can be associated with an additional pipe connected in parallel and serving to improve the mechanical connection between the resonator 26 and the muffler 24.

The muffler 24 is made of sheet metal. It is advantageously made by rolling up a single metal sheet whose adjacent edges are connected together by crimping. Metal end walls or "end plates" are fitted to the tube thus formed by crimping. The casing of the muffler is thus constituted by the rolled side wall and the end walls.

In a variant, the muffler can be stamped so as to give it a complex shape, should that be necessary for an application under consideration.

The inside of the exhaust muffler 24 contains any type of means adapted to reducing sound emission.

The exhaust muffler 24 has an inlet 29 for connection to the upstream exhaust tube coming from the intermediate muffler 18. At its opposite end, it has an outlet opening 30 to which the nozzle 22 is connected.

In accordance with the invention, the resonator 26 forming the additional enclosure is made of a polymer material. Thus, the structure of the additional enclosure 26 is less resistant to high temperature than is the structure of the muffler 24.

The polymer materials used for making the resonator 26 are, for example, thermosetting resin components, optionally including a filler, optionally reinforced, e.g. being made of glass or carbon fibers and epoxy, polyester, or vinylester resins. These polymers can also be thermoplastic polymers, optionally containing a filler, optionally reinforced. Polyamides, polypropylenes, or indeed liquid crystal polymers can be used in satisfactory manner in this application.

By using polymers to make the resonator 26, it is possible to give it an outside shape that is complex, thus making it possible to make best use of the empty space present beneath the body of the vehicle or at the end of the vehicle. In the embodiment shown, the resonator is received in part inside a cavity defined by a rear shield of the vehicle referenced 32. Similarly, the resonator 26 matches the shape of the spare wheel of the vehicle, referenced 34.

In a variant, the resonator is disposed between the spare wheel and the fuel tank or in any other cavity situated beneath the structure of the vehicle or at one end of the vehicle.

The architecture of the exhaust volume of the invention made up of two distinct and interconnected enclosures enables these enclosures to be made of materials that withstand high temperature in different manners. In particular, the muffler 24 is made of a material or has a structure having the ability to withstand high temperature that is better than that of the material of the additional enclosure or than that imparted to it by its structure.

Since the resonator 26 constitutes a blind enclosure, it does not have exhaust gases at high temperature passing through it. It is therefore not subjected to high temperatures. When the resonator 26 is connected to the muffler 24 by two pipes, the dimensional characteristics thereof are adapted to ensure that no gas circulation is set up through the resonator 26.

The resonator can thus be made out of a material such as a polymer which even though it can withstand low temperatures only nevertheless makes it easier to manufacture the resonator with a complex shape enabling it to fit closely to the outline of the empty spaces available beneath the vehicle.

In a variant, the resonator 26 is made of a light alloy such as aluminum, magnesium, or titanium, which is easy to shape and low in density.

Furthermore, it is found that for a given total volume for the exhaust volume 20, subdividing the volume into enclosures 24 and 26 interconnected by a pipe 28 provides better results acoustically than does an exhaust volume having the same volume and constituted by a single enclosure.

Figure 3:
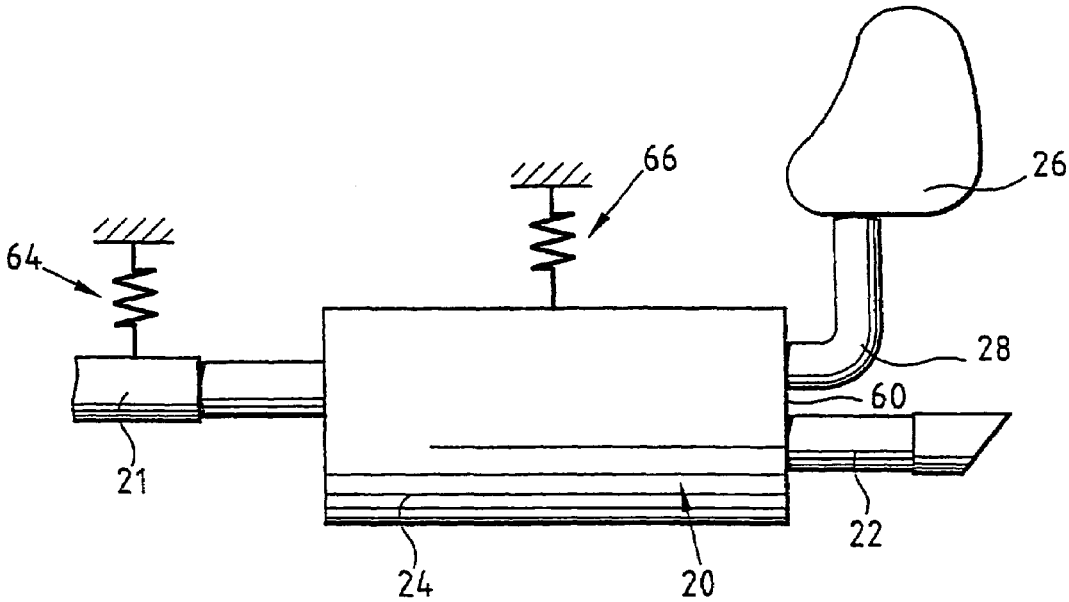
FIGS. 3, 4, and 5 are fragmentary diagrammatic views showing various embodiments of the FIG. 2 exhaust system showing in particular variant ways of securing the system to the motor vehicle body.
Figure 4:
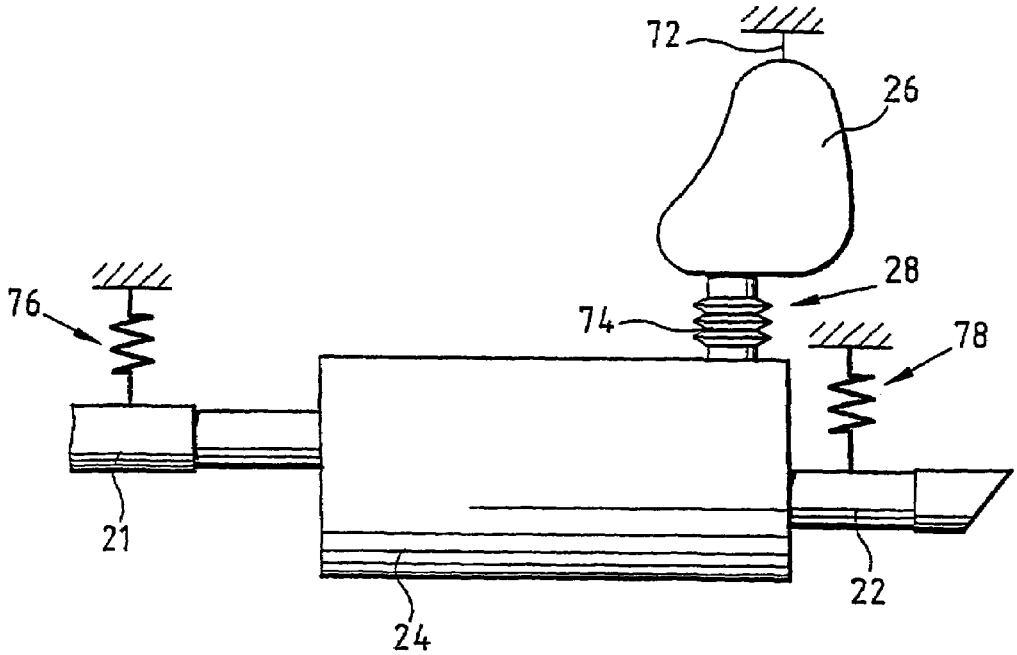
Figure 5:
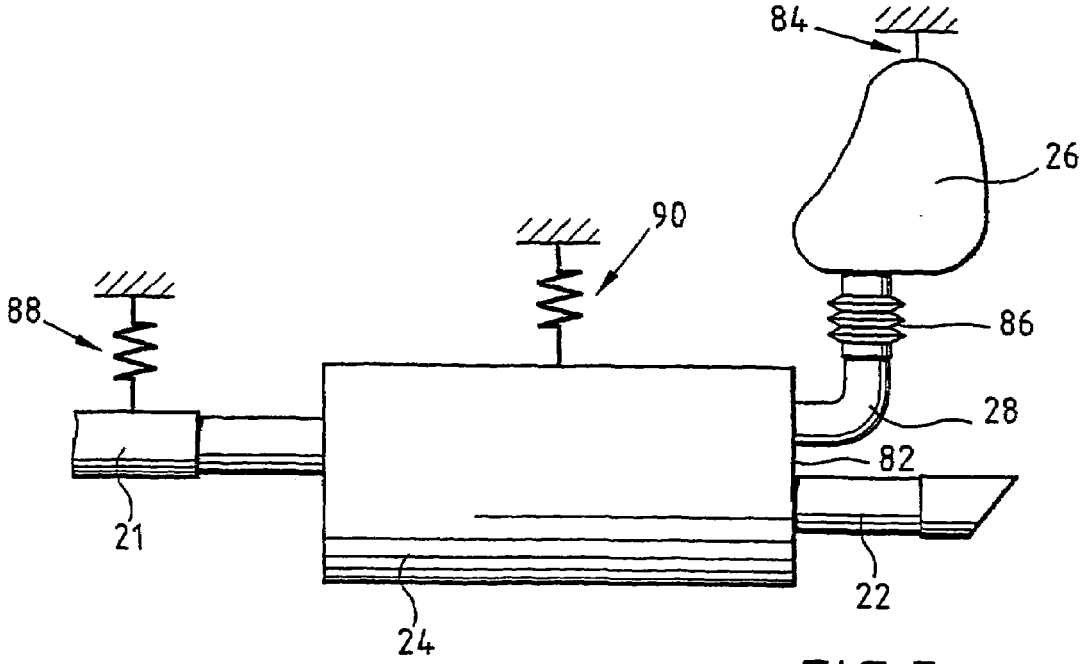

FIGS. 3 to 5 show various ways in which the exhaust volume of the invention can be made together with distinct means for coupling it to the body of the vehicle.

Figure 2:
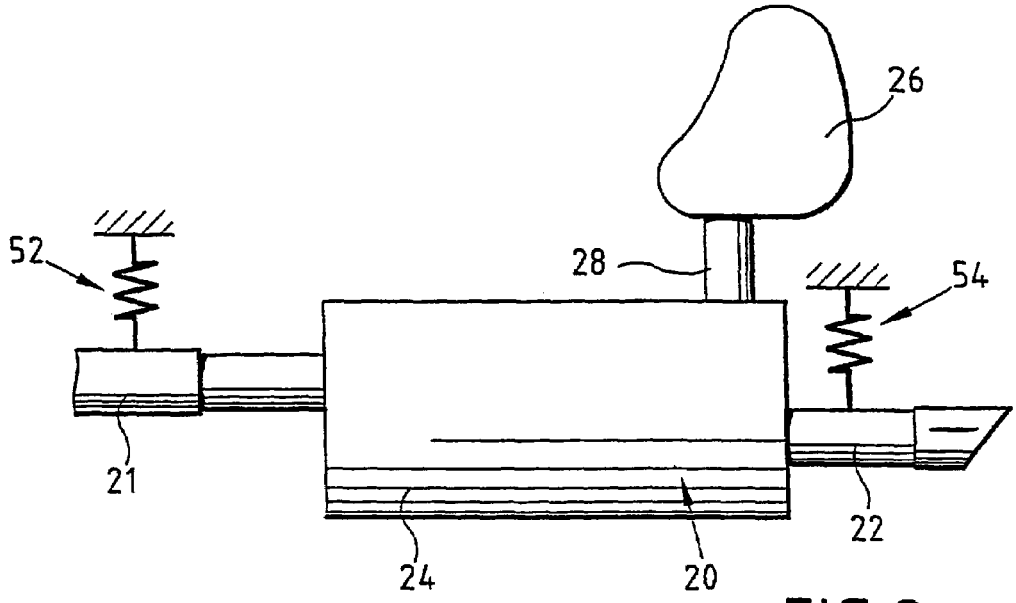
FIG. 2 is a diagrammatic fragmentary view of an exhaust system of the invention showing how an exhaust volume of the invention is secured to the body of the vehicle.

In the embodiment of FIG. 2, the resonator 26 is connected directly to the side wall of the casing of the muffler 24. The connection tube 28 is constituted by a rigid tube. In particular, this tube presents sufficient bending strength to support the weight of the resonator 26 since the resonator itself has no attachment to the body of the vehicle.

Thus, in this embodiment, the resonator 26 is cantilevered out by the connection tube 28. The tube likewise has no means connecting it to the structure of the vehicle, so it is self-supporting.

To secure the exhaust volume 20, two flexible links 52 and 54 are provided, one between the connection tube 21 and the body of the vehicle, and the other between the nozzle 22 and the body of the vehicle.

These flexible links can be formed, for example, by elastically-deformable blocks of rubber each having one end connected to the body of the vehicle and its other end connected to the part it supports.

In the embodiment of FIG. 3, the resonator 26 is connected by the connection tube 28 to an end wall 60 of the muffler 24 in the vicinity of the nozzle 22. As in the preceding embodiment, the connection tube 28 is rigid and supports the weight of the resonator 26.

The exhaust volume is secured to the body of the vehicle by a flexible link 64 provided between the upstream tube 21 and the body of the vehicle. In addition, a second flexible link 66 is provided between the exhaust muffler 24 and the body of the vehicle.

In the embodiment of FIG. 4, the resonator 26 is connected to the exhaust muffler 24 via the side wall thereof. The resonator 26 is held to the body of the vehicle by a rigid link 72. This link is provided, for example, by a rigid tab integrally molded with the resonator or stuck thereto, and bolted or welded at its other end to the body of the vehicle.

The connection tube 28 includes an elastically-deformable segment 74 to avoid transferring vibration between the resonator 26 and the exhaust muffler 24. The elastically-deformable segment 74 can be constituted, for example, by a metal bellows or by a tube of non-metallic deformable material, or by a combination of materials.

In addition, a first flexible link 76 is provided between the upstream tube 21 and the body of the vehicle. A second flexible link 78 is provided between the nozzle 22 and the body of the vehicle.

In this embodiment, the exhaust volume is suspended from the body of the vehicle firstly by a rigid link 72 connecting the resonator 26, and secondly by two flexible links disposed at opposite ends of the exhaust muffler.

Decoupling between the muffler and the resonator avoids vibration being transmitted from the muffler which is mounted so as to be capable of moving relative to the resonator which is itself rigidly connected to the body of the vehicle.

In the embodiment of FIG. 5, the resonator 26 is connected to the exhaust muffler via the rear wall 82 thereof.

As before, the resonator is secured to the body of the vehicle by a rigid link 84. An elastically-deformable segment 86 is provided in the connection tube 28.

In addition, a first flexible link 88 is provided between the upstream tube 21 and the body of the vehicle. A second flexible link 90 is provided between the casing of the exhaust muffler 24 and the body of the vehicle. The nozzle 22 is self-supporting and is cantilevered out from the exhaust muffler to which it is secured.

In this embodiment, the exhaust volume is thus supported firstly by the rigid link 84 applied to the resonator 26 and secondly by two flexible links 88 and 90 applied respectively to the tube upstream from the exhaust volume and to the exhaust muffler 24.

The invention claimed is:

1. An exhaust volume of the type comprising a muffler having a casing provided with an inlet and an outlet for passing gases and adapted to enable the muffler to be mounted in an exhaust system, the volume further comprising an additional enclosure forming an accumulation cavity communicating solely with the casing of the muffler via at least one connection pipe, said additional enclosure being placed outside the muffler, and the additional enclosure is of a structure whose ability to withstand high temperature is lower than that of the structure of the muffler.

2. An exhaust volume according to claim 1, wherein the casing of the muffler is made of metal and the casing of the additional enclosure is made of a material comprising a polymer.

3. An exhaust volume according to claim 1, wherein the casing of the muffler is of steel and the casing of the additional enclosure is made of light alloy.

4. An exhaust volume according to claim 1, wherein the connection pipe is rigid and substantially undeformable by the weight of the additional enclosure at one end of said connection pipe.

5. An exhaust volume according to claim 1, wherein the connection pipe includes an elastically-deformable segment, and the additional enclosure has rigid link means connecting it to the body of the vehicle.

6. An exhaust system of the type comprising an exhaust volume according to claim 1, an upstream exhaust tube connected to the inlet of the muffler, and a downstream exhaust tube connected to the outlet from the muffler.

7. An exhaust system according to claim 6, wherein the connection pipe includes an elastically-deformable segment, and wherein the system includes rigid link means between the additional enclosure and the body of a vehicle, and flexible link means between the body of a vehicle and the upstream exhaust tube and at least one of the mufflers and the downstream exhaust tube.

8. An exhaust system according to claim 6, wherein the connection pipe is rigid and substantially undeformable by the weight of the additional enclosure at one end of said connection pipe, the system including flexible link means between the body of a vehicle and both the upstream exhaust tube and at least one of the muffler and the downstream exhaust tube, and the additional enclosure has no link means connecting it to the body of the vehicle.

9. A motor vehicle including at least one exhaust system according to claim 6, wherein the additional enclosure is received, at least in part, within a cavity situated beneath the structure of the vehicle or at one end of the structure of the vehicle.

10. An exhaust volume according to claim 1, wherein said additional enclosure is non-expandable.

11. The exhaust volume according to claim 1, wherein said accumulation cavity forms an enclosed volume which only accumulates exhaust gas received through said connection pipe so that there is no flow of gas through said additional enclosure.

12. The exhaust system according to claim 6, wherein said accumulation cavity forms an enclosed volume which only accumulates exhaust gas received through said connection pipe so that there is no flow of gas through said additional enclosure.

13. The motor vehicle according to claim 9, wherein said accumulation cavity forms an enclosed volume which only accumulates exhaust gas received through said connection pipe so that there is no flow of gas through said additional enclosure.

* * * * *